US005226448A

United States Patent [19]

Schiller

[11] Patent Number: 5,226,448

[45] Date of Patent: Jul. 13, 1993

[54] FREEZE SAFETY BOX ORGANIZATION

[76] Inventor: Michael Schiller, 3351 Taylor Lakes, Livingston, Tex. 77351

[21] Appl. No.: 305,672

[22] Filed: Jun. 29, 1992

[51] Int. Cl.[5] ..... E03B 7/10

[52] U.S. Cl. ..... 137/559; 137/68.1; 137/59; 138/32

[58] Field of Search ..... 137/59, 62, 68.1, 797, 137/551, 559; 138/32; 116/276, DIG. 7, DIG. 27

[56] References Cited

U.S. PATENT DOCUMENTS

| | | | |
|---|---|---|---|
| 213,292 | 3/1879 | Lunkenheimer | 138/32 X |
| 931,112 | 8/1909 | Ballard | 137/59 |
| 1,687,027 | 8/1928 | Calhoun | 138/32 X |
| 3,319,657 | 5/1967 | Nyiri | 137/59 X |
| 3,926,051 | 12/1975 | Katzman | 138/32 X |

*Primary Examiner*—John Rivell
*Attorney, Agent, or Firm*—Leon Gilden

[57] ABSTRACT

A plumbing box mounted in fluid communication with fluid pipes within wall structure is arranged to provide for threaded bores for securement of the pipes thereto, with a front wall of the box or housing structure having a plug member frictionally retained within a front wall smooth bore. Upon freezing of fluid within the box structure, the plug member is displaced relative to the box indicating pipe freezing, with the plug member arranged with its cap portion coplanar with a wall surface for visual indication of a freezing condition within the pipe structure directed into the box.

2 Claims, 4 Drawing Sheets

FREEZE SAFETY BOX ORGANIZATION

BACKGROUND OF THE INVENTION

1. Field of the Invention

The field of invention relates to plumbing structure, and more particularly pertains to a new and improved freeze safety box organization wherein the same is arranged for visual indication of a freezing condition within fluid pipes and plumbing.

2. Description of the Prior Art

Plumbing pipes and the like are typically positioned within wall structure of construction, such as individual homes, wherein freezing of such pipes is typically unnoticed until subsequent thawing effects water damage. The repairing of such pipes prior to thawing is desirable to eliminate the attendant water damage resultant from thawing, wherein the instant invention addresses this problem by providing for a plug member arranged in a coplanar relationship relative to an existing wall structure that projects from the wall structure upon freezing within the associated freeze box. Various plumbing indicator structure has been presented in the prior art such as exemplified by the U.S. Pat. No. 4,932,429 to Watanabe including a fluid passage escape structure.

U.S. Pat. No. 4,657,038 to Lyons sets forth a further example of anti-freeze structure having fluid trickle through a pipe to prevent freezing therewithin.

U.S. Pat. No. 4,766,923 to Roper sets forth a freeze safety valve mounted at a distal end of a conduit pipe having a plug becoming dislodged upon pressure effecting dislodgement of a plug permitting fluid flow therethrough.

As such, it may be appreciated that there continues to be a need for a new and improved freeze safety box organization as set forth by the instant invention which addresses the problems of ease of use as well as effectiveness in construction and in this respect, the present invention substantially fulfills this need.

SUMMARY OF THE INVENTION

In view of the foregoing disadvantages inherent in the known types of freeze safety devices now present in the prior art, the present invention provides a freeze safety box organization wherein the same is arranged to effect dislodgement of a plug member relative to a wall structure for indication of freezing within plumbing pipes. As such, the general purpose of the present invention, which will be described subsequently in greater detail, is to provide a new and improved freeze safety box organization which has all the advantages of the prior art plumbing structure and none of the disadvantages.

To attain this, the present invention provides a plumbing box mounted in fluid communication with fluid pipes within wall structure arranged to provide for threaded bores for securement of the pipes thereto, with a front wall of the box or housing structure having a plug member frictionally retained within a front wall smooth bore. Upon freezing of fluid within the box structure, the plug member is displaced relative to the box indicating pipe freezing, with the plug member arranged with its cap portion coplanar with a wall surface for visual indication of a freezing condition within the pipe structure directed into the box.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved freeze safety box organization which has all the advantages of the prior art plumbing structure and none of the disadvantages.

It is another object of the present invention to provide a new and improved freeze safety box organization which may be easily and efficiently manufactured and marketed.

It is a further object of the present invention to provide a new and improved freeze safety box organization which is of a durable and reliable construction.

An even further object of the present invention is to provide a new and improved freeze safety box organization which is susceptible of a low cost of manufacture with regard to both materials and labor, and which accordingly is then susceptible of low prices of sale to the consuming public, thereby making such freeze safety box organizations economically available to the buying public.

Still yet another object of the present invention is to provide a new and improved freeze safety box organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
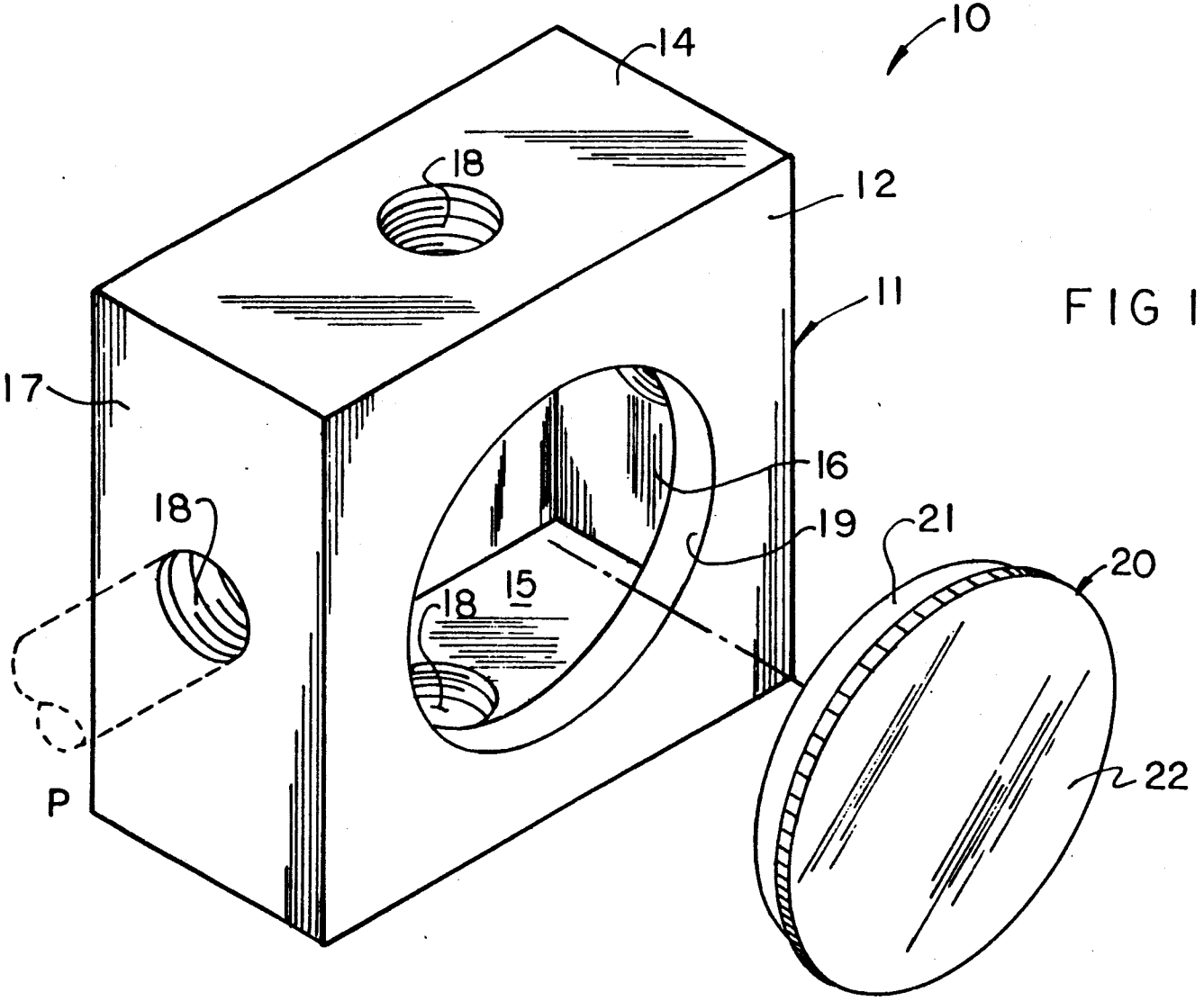
FIG. 1 is an isometric illustration of the instant invention.

With reference now to the drawings, and in particular to FIGS. 1 to 4 thereof, a new and improved freeze safety box organization embodying the principles and concepts of the present invention and generally designated by the reference numerals 10, 10*a*, and 10*b* will be described.

More specifically, the freeze safety box organization 10 of the instant invention essentially comprises a housing 11 having a housing front wall 12, a housing rear wall 13, a housing top wall 14 spaced from a housing bottom wall 15. Housing first and second side walls 16 and 17 respectively are provided to form the enclosure structure, as illustrated in FIG. 1. The top, bottom, first side, and second side walls 14–17 each include threaded bores 18 to receive a fluid pipe "P" 18, or alternatively an externally threaded plug 34 (see FIG. 4) to permit selective fluid flow through the housing 11. The housing front wall includes a front wall smooth bore 19 of a first diameter arranged to receive a plug member 20 having a cylindrical skirt 21 of said first diameter to be frictionally received in a complementary relationship within the smooth bore 19. A plug cap 22 mounted to the cylindrical skirt 21 extends laterally beyond the cylindrical skirt for abutment with the front wall 12. Typically, the plug cap 22 is arranged in a coplanar relationship relative to a wall structure "W" (see FIG. 4), whereupon freezing of fluid within the housing 11 effects projection of the plug cap 22 relative to the wall structure "W" for visual indication of freezing within the plumbing organization permitting repair prior to water damage.

Figure 2:
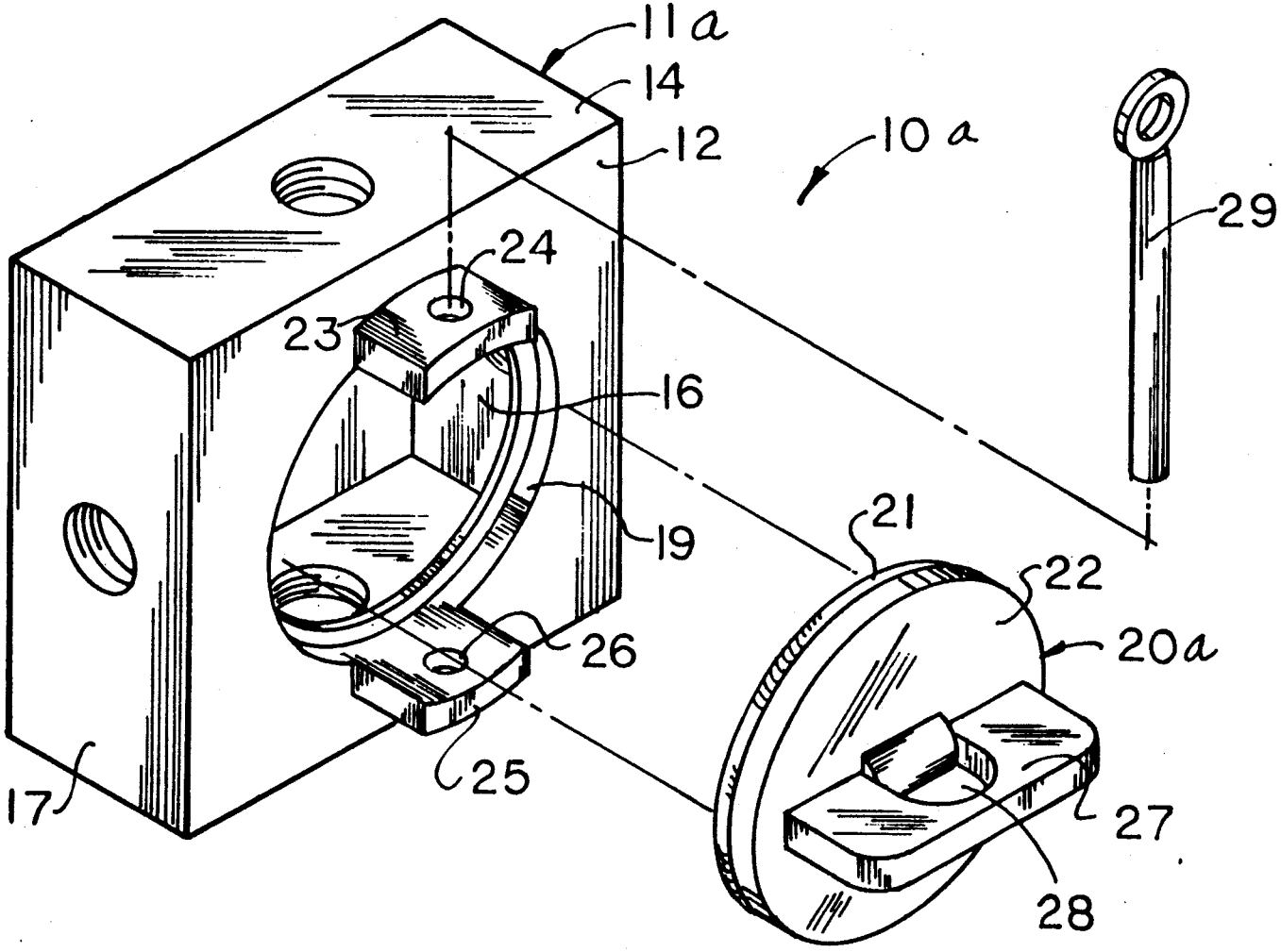
FIG. 2 is an isometric illustration of a modification of the invention.

A modified organization 10*a*, as illustrated in the FIG. 2, includes front wall first and second flanges 23 and 25 respectively diametrically mounted to opposed sides of the smooth bore 19, wherein the first and second flanges 23 and 25 are arranged to include respective first and second flange bores 24 and 26. The first and second flange bores 24 and 26 are coaxially aligned relative to one another to define the modified housing 11*a*. A modified plug member 20*a* includes a plug cap flange 27 projecting orthogonally beyond the plug cap 22 having a plug cap flange opening 28 that is arranged for alignment with the first and second flange bores 24 and 26, whereupon a sheer pin 29 is directed through the first and second flange bores 24 and 26, as well as the cap flange opening 28 whereupon freezing, the manner and type of sheer pin utilized permits individuals to limit projecting of the plug member 20*a* depending upon predetermined pressurizing of the housing 11*a* by freezing therewithin.

Figure 3:
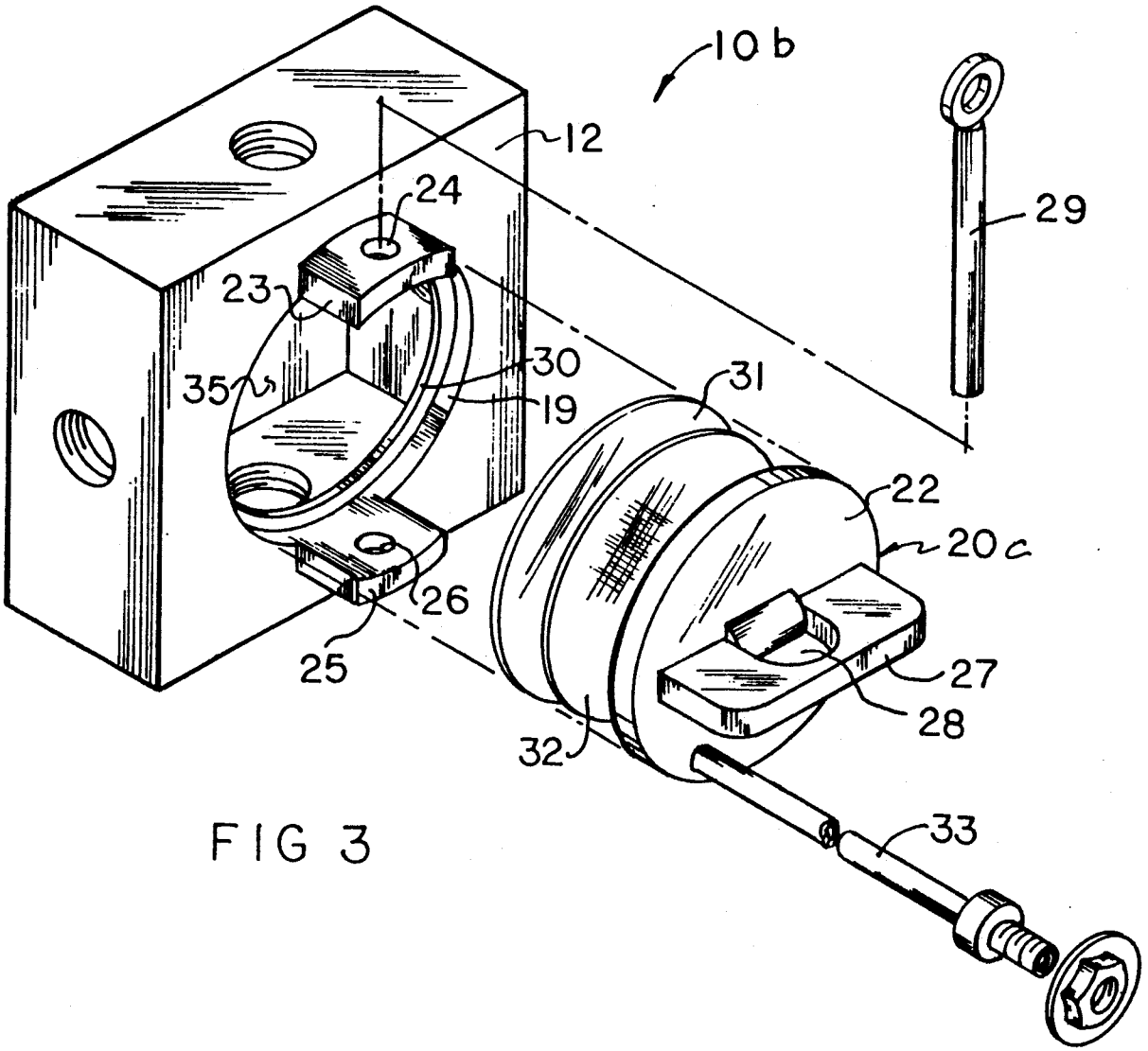
FIG. 3 is an isometric illustration of a further modification of the invention.
Figure 4:
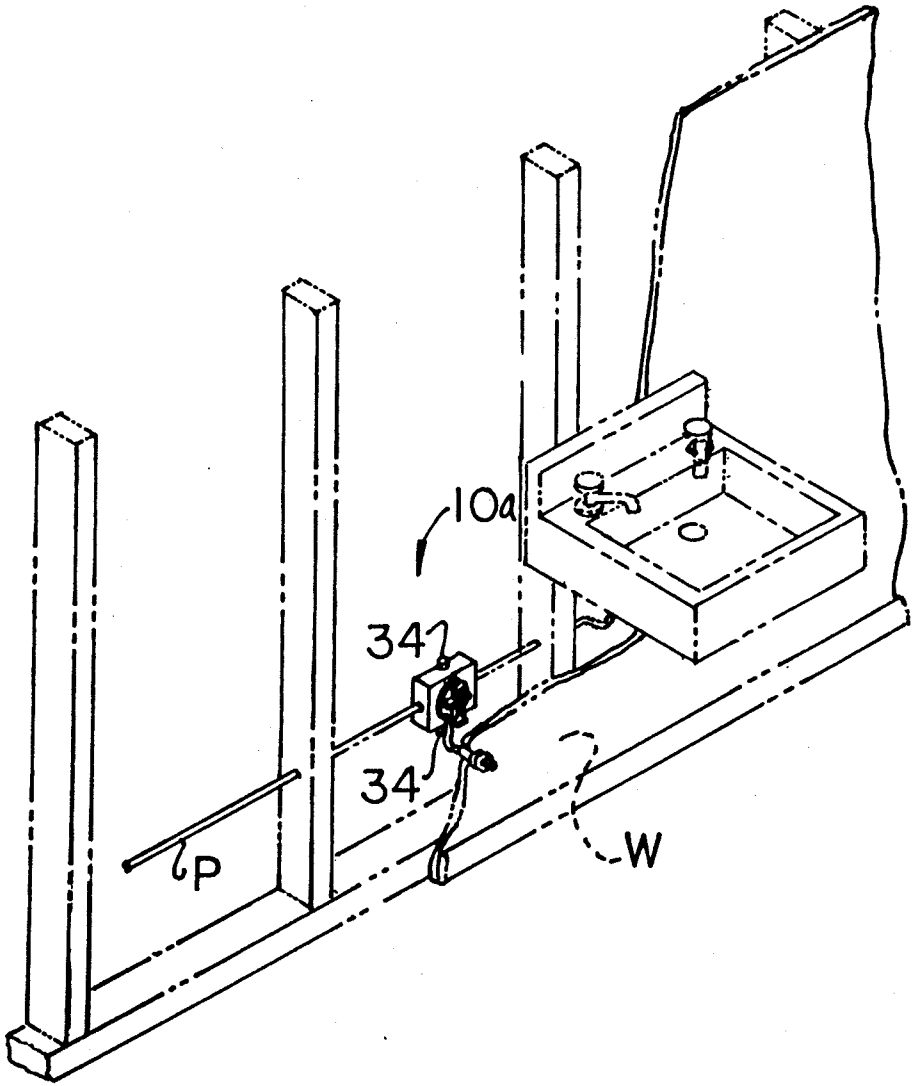
FIG. 4 is an isometric illustration of the instant invention in use.

The further modified organization 10*b*, as illustrated in FIG. 3, includes a front wall counter-bore 30 positioned adjacent the housing cavity 35 by a second diameter greater than the first diameter to receive a pressure plate 31 therewithin. The pressure plate 31 includes a fluid dye impregnated fabric web 32 positioned adjacent pressure plate 31, with the fabric web 32 positioned between the pressure plate 31 and the modified plug member 20*a*. A sight tube 33 orthogonally directed through the plug cap 22 is positioned in a spaced relationship relative to the fabric web 32, whereupon freezing within the housing cavity 35 deflects the pressure plate 31 to direct the fluid dye impregnated fabric web 32 against the plug member 20*a* and the sight tube, whereupon visual indication of deflection is thereby permitted through the sight tube to permit a preliminary warning of freezing within the housing cavity 35 prior to displacement of the plug cap 22 relative to the front wall 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A freeze safety box organization, comprising, a housing, the housing including a front wall spaced from a rear wall, a top wall spaced from a bottom wall, and a first side wall spaced from a second side wall, the top wall, the bottom wall, the first side wall, and the second side wall each include bore members to receive a fluid pipe therethrough, with the housing defining a housing cavity permitting fluid communication of said pipe with the housing cavity, and the front wall including a front wall smooth bore, the smooth bore further including a plug member, the plug member including a cylindrical skirt frictionally and complementarily received within the smooth bore, and the cylindrical skirt having a cap mounted to an upper distal end of the cylindrical skirt, the cylindrical skirt and the smooth bore mounted along a predetermined axis, with the cap orthogonally oriented relative to the axis permitting displacement of the plug member relative to the front wall upon fluid freezing within the housing cavity, and the front wall includes a first flange and a second flange, the first flange and the second flange orthogonally mounted to the front wall diametrically positioned on opposed sides of the smooth bore, the first flange including a first flange bore, the second flange including a second flange bore, the first flange bore and the second flange bore coaxially aligned relative to one another, and the plug cap further including a plug cap flange orthogonally mounted to the plug cap, with the plug cap flange including a cap flange opening, the cap flange opening aligned with the first flange bore and the second flange bore, and a frangible sheer pin directed through the first flange bore, the second flange bore, and the cap flange opening.

2. An organization as set forth in claim 1 wherein the smooth bore includes a smooth bore counter-bore, the smooth bore defined by a first diameter, the smooth bore counter-bore defined by a second diameter, with the counter-bore positioned adjacent the housing cavity, and a pressure plate mounted within the counter-bore, the pressure plate defined by said second diameter, and a fluid dye impregnated fabric web positioned adjacent the pressure plate between the pressure plate and the plug member, and a sight tube orthogonally directed through the plug cap, with the sight tube spaced from the fabric web within the plug cap, whereupon freezing of said fluid within the housing cavity effects displacement of the pressure plate and the fabric web into communication with the sight tube to permit visual observation of fluid dye from said fluid dye impregnated fabric web directed through said sight tube.

* * * * *